United States Patent [19]

Farris

[11] Patent Number: 4,869,138

[45] Date of Patent: Sep. 26, 1989

[54] NEW AND IMPROVED RATCHET TOOL WITH ROTATABLE ROTOR LOCK AND RIGID SHIFTER FINGER

[76] Inventor: Jim L. Farris, Rt. 1, P.O. Box 261, Sheridan, Ark. 72105

[21] Appl. No.: 153,044

[22] Filed: Feb. 8, 1988

[51] Int. Cl.[4] ..... B25B 13/46

[52] U.S. Cl. ..... 81/63; 81/63.2

[58] Field of Search ..... 81/60–63.2

[56] References Cited

U.S. PATENT DOCUMENTS 3,659,484 5/1972 Scodeller ..... 81/63

3,724,298 4/1973 Howard ..... 81/63

*Primary Examiner*—Frederick R. Schmidt

*Assistant Examiner*—M. Rachuba

*Attorney, Agent, or Firm*—Veo Peoples, Jr.

[57] ABSTRACT

An improved ratchet tool having a rotatable handhold, coupled with a shaft telescoped in a tubular handle is made more simple and more securely self-locking by the presence of a rotary lock device for the rotor that drives the tool and a rigid shifter finger offset radially from the shaft axis which projects from the end of the shaft into a recess within the rotary lock to rotate the lock to corresponding direction changing positions upon manual rotation of the handhold, while simultaneously securely locking the rotor against undesirable movement when under loaded torque.

3 Claims, 3 Drawing Sheets

FIG. 6A
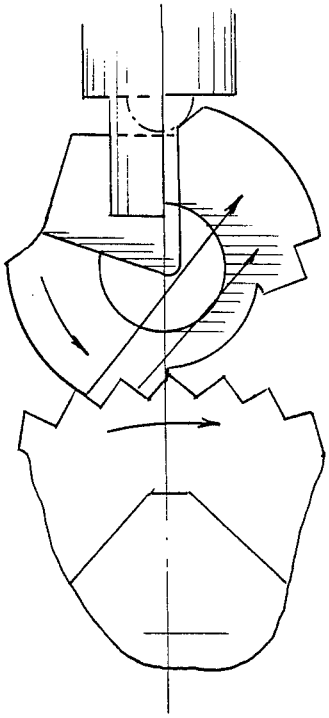
FIG. 7A
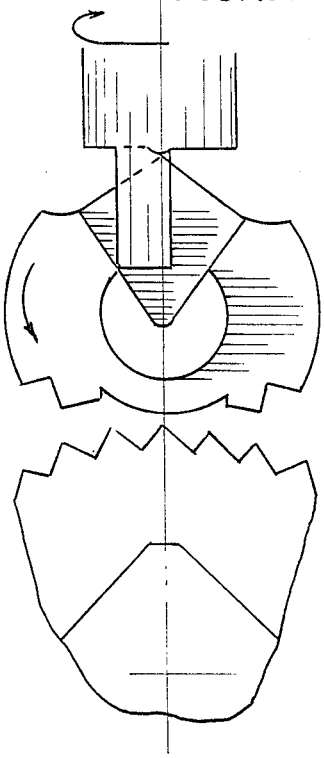
FIG. 8A
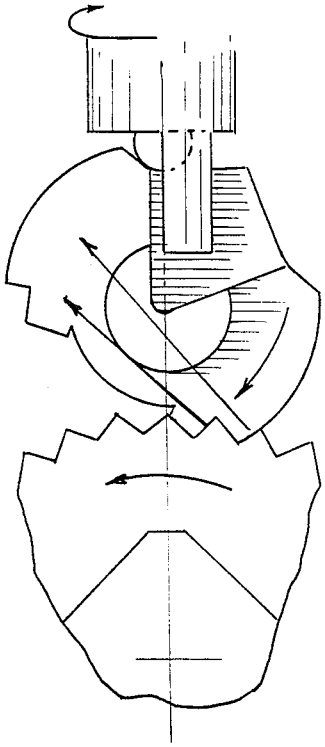
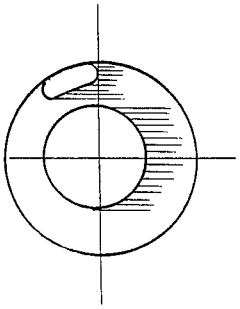
FIG. 6.
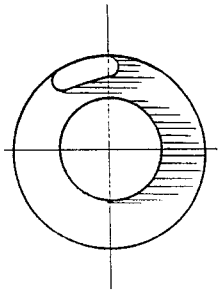
FIG. 7.
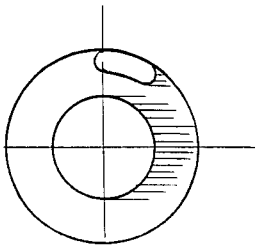
FIG. 8.

NEW AND IMPROVED RATCHET TOOL WITH ROTATABLE ROTOR LOCK AND RIGID SHIFTER FINGER

BACKGROUND OF THE INVENTION

This invention relates to tools, and more particularly to an improved ratchet handle for socket wrenches or similar tools.

Ratchet handles for tools of this general kind have long been available, as for example, from U.S. Pat. Nos. 2,058,855; 2,967,377; 3,019,682; and 685,698. They are required by mechanics and workmen who must manipulate tools in cramped or relatively inaccessible locations where insufficient operating room is available for movement of tools not equipped with the ratchet feature. The ratchet handles have conventionally been provided with any of a variety of small levers or dials to be operated by the user in order to change the direction of affective movement of the tool driver components of the handle. These levers have been located in various positions for operation by the workman's fingers. No matter how accessible they may be, however, manipulation of these levers or dials almost always requires use of the workman's "free" hand, or else release of his grip on the ratchet handle.

Generally, the workman cannot conveniently remove his grip on the handle without losing the precise positioning of the tool which may be important to the operation in which the workman is engaged. The so-called "free" hand may be very vitally engaged in holding some other article necessary to the operation. The entire problem is aggravated by the restricted or cramped position often available to the workman, and also by the presence of slippery oils and greases which frequently coat the tools and handles when the direction change is to be made.

To overcome these problems, ratchet tool handles have been developed which permit a change in the direction of effective drive by a mere twist of the workman's wrist. See for example, U.S. Pat. No. 3,608,402. However, such devices have been previously locked by action of a springy projectile for biasing wedge members toward or away from cam surfaces at one side or the other of the housing itself. The yieldable character of these spring members fail to provide adequate and secure locking of the rotor and require the locking positions for adjustment at 180 degree turns or the like. Such tools require an excessive number of parts, are cumbersome to manufacture, and are inconvenient to use in restricted places where a 180 degree turn of the workman's wrist is impractical.

SUMMARY OF THE INVENTION

Accordingly, it is a primary object of this invention to provide an improved ratchet tool handle constructed to permit a change in the direction of effective drive of its rotor by a mere twist of the workman's wrist by no more than about 45 degrees.

It is a further object of the present invention to provide an improved ratchet tool handle, lockable by turning the handle with the workman's wrist, having a more secure self-locking feature as against the biased direction.

Another object of the invention is to provide a ratchet mechanism which may be shifted to opposite operating direction conditions by a rotary wrist action without necessitating a camming action against the housing of the wrench.

Still another object of the invention is to provide a ratchet mechanism having fewer parts than previous ratchet mechanisms for shifting to opposite operating direction conditions by a rotary wrist action.

These and other objects of this invention will be further explained or will become apparent from the several drawing figures, from the specification, and the claims.

DESCRIPTION OF THE DRAWINGS

FIGS. 6 and 6*a* are fragmentary top views of the rotor engaging the rotary lock while the shifter finger biases the lock, and thus the rotor, against counterclockwise rotation;

FIGS. 7 and 7*a* are fragmentary views of the rotor and rotary lock disengaged as the shifter finger is midway between securing the respective locking positions;

FIGS. 8 and 8*a* are fragmentary drawings showing the rotor and rotary lock engaged while the shifter finger biases against clockwise motion.

DETAILED DESCRIPTION

Figure 1:
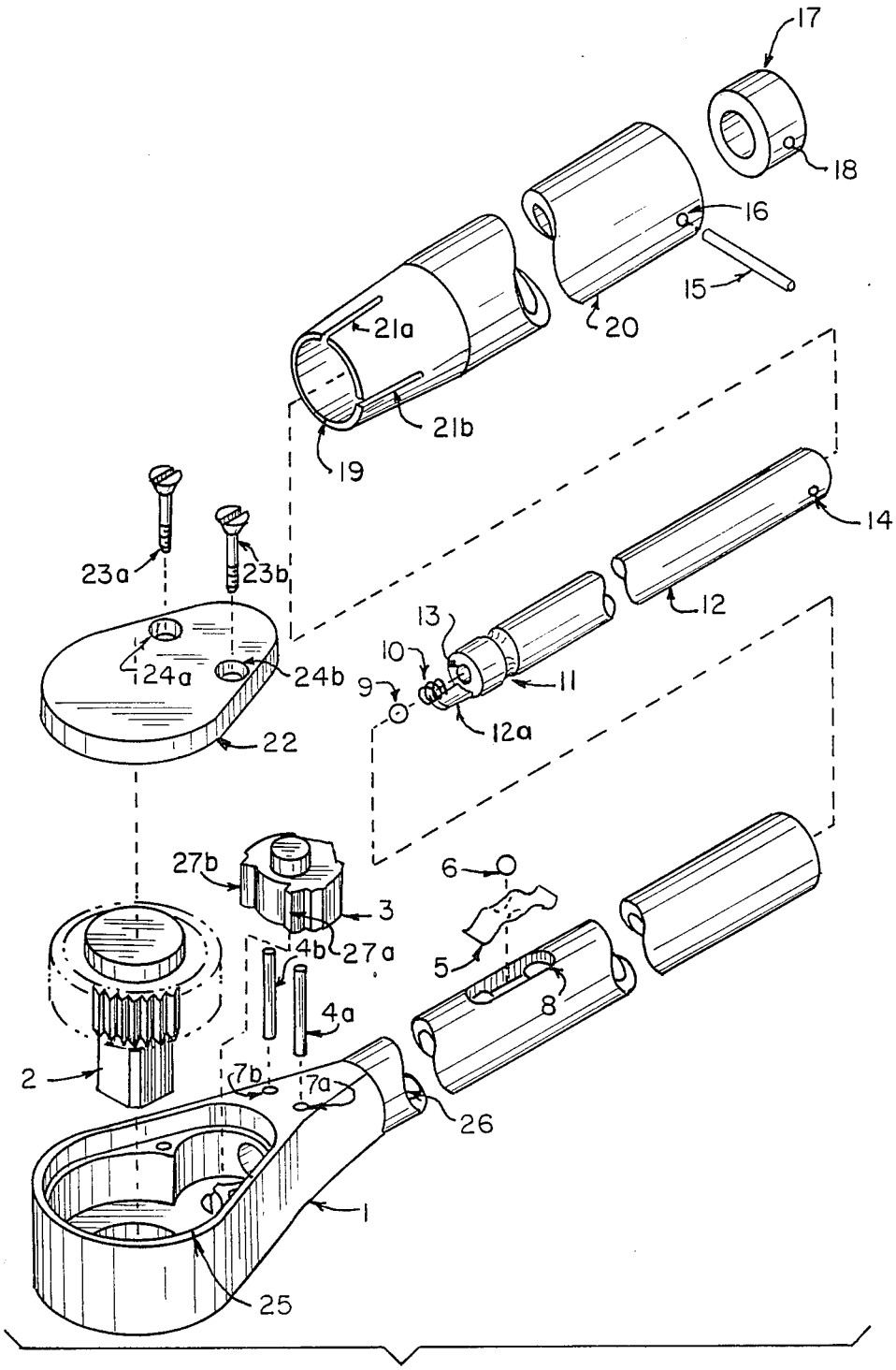
FIG. 1 is a perspective view of the disassembled parts of the ratchet tool handle of this invention embodying dotted lines describing its construction.

A ratchet handle embodying the principals of this invention is broadly designated in FIG. 1 of the drawings. Reference numeral (1) designates the housing or outer body of the wrench handle having an oblonged surface opening (25) at its large end or tube, a surface slot (8) along its smaller cylindrical end, two parallel holes (*7a*) and (*7b*), and a generally circular inner wall surface throughout its smaller cylindrical end. The inner surface (26) of the ratchet handle body (1) receives in telescoped relationship an elongated, transversely circular, solid shaft or shifter rod (12). A tubular member (20) is telescoped over the outside of the small end of the housing (1). Member (20) is integrally connected with shaft (12) by an end plate spacer (17), which is inserted within the large end of the tubular handhold (20), whose small hole (16) is aligned with the small hole of the end spacer (18) and the small hole of the shaft (14) to receive pin (15) that secures the integral connection as between these three members, the handhold tubular member (20), the end spacer (17), and the shaft (12).

Figure 3:
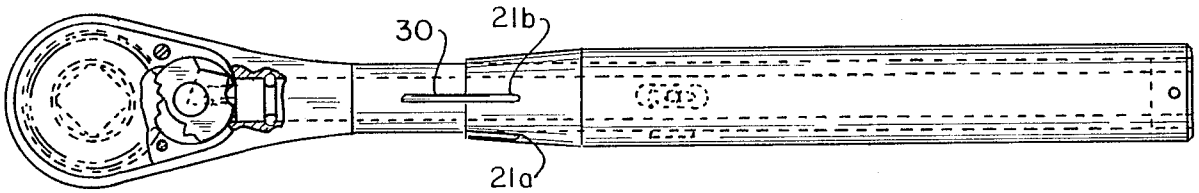
FIG. 3 is a partial cross-sectional top view of the ratchet tool handle of the invention.

Roll pins (*4a*) and (*4b*) fit securely through laterally bored holes (*7a*) and (*7b*), respectively, of the housing (1), and serve to retainably align the shaft by engagement with the groove (11) of the shaft as is more clearly demonstrated by the fractional cross-section shown in FIG. 3. FIG. 1 furthermore, shows how the rotary lock (3) fits rotatably into the lower portion of the oblong opening (25) with the rotary locks cam surfaces (*27a*)

and (27*b*) placed towards the top of the assembly. The rotor (2) for driving the ratchet tool fits rotatably into the top portion of oblong opening (25). The oblong or egg-shaped face (22) fits over the rotor and rotary lock so as to close opening (25) and said face is secured by screws (23*a*) and (23*b*) through openings (24*a*) and (24*b*) on said plate or face.

A ball member (6) is rollingly engaged to engage with a wavy spring (5), which rests in slot (8) of the ratchet wrench housing or body (1). The top of the ball member (6) rests against a detent (28) on the inner surface of the tubular handhold (20) "to lock the housing to the handhold". The ball member rests sufficiently loosely in the detent (28) that wrist action of the handhold (20) allows the housing or body (1) of the wrench to release and rotate while fitting snuggly enough to prevent the body (1) from slipping or releasing when in the no-load position.

Figure 2:
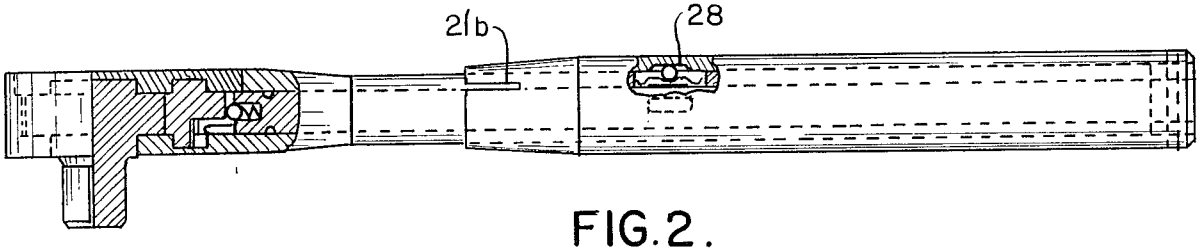
FIG. 2 is a partial cross-section side view of the ratchet tool handle of the present invention showing the engagement of the rotor, the rotary lock, the shifter finger, a ball and spring guide, and the housing, together with the shaft at its top cross-sectional purview.

FIG. 2 of the drawings shows a cross-section that illustrates the interconnection of the detent (28), the ball member (6), the wavy spring (5), and the slot (8).

Figure 5:
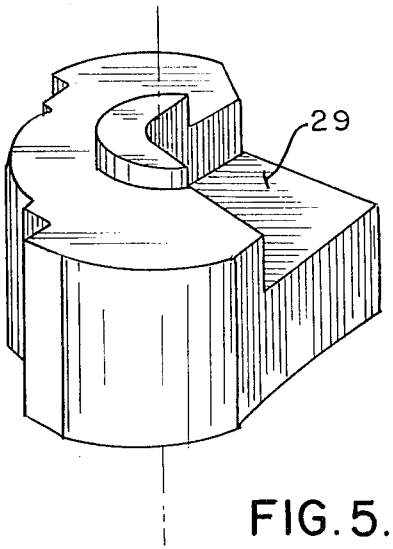
FIG. 5 is a perspective view of the rotary lock of the ratchet tool of the present invention.
Figure 4:
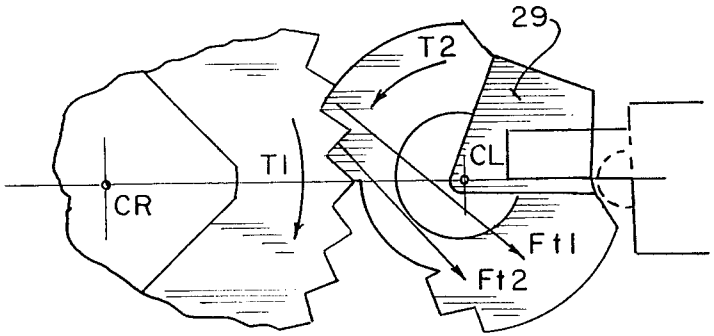
FIG. 4 is a fragmentary view of the engagement of the rotor and the rotary lock of the invention, having a magnified perspective of the shifter rod finger projecting into the recess of the rotary lock.

At the top end of the shaft or shifter rod (12), there is a circular detent (13) centered on the top face of the shaft. The detent (13) receives a coil spring (10) and a ball (9) that work together to provide sufficient engaging force against the rotary lock (3). Unlike spring members from prior art ratchet tools of this type which projected against wedge members and which serve to bias the rotor driving means as against one direction and the other, while also exerting pressure on the rotor, the ball (9) and spring (10) of the present invention merely assert engaging pressure without having to also bias the rotor in opposite directions, and therefore, the need for prior art wedge members and camming action against the housing of the wrench is negated. Also, fixed to the top end of the shaft or shifter rod is a shifter finger (12), off-set radially from the shaft axis, which projects into a pie-shaped recess (29) having not more than a 40° angle of the rotary lock (3) as may be more readily shown in FIG. 4. Thus, upon a mere 45 degree turn of the handhold (20) in either direction, the shaft (12) which is connected to said handhold (20) by the rod (15) will turn the shifter finger biasing said rotary lock in one direction or the other, and the rotary lock (3) at its cam faces (27*a*) or (27*b*) would thus bias the rotor driving means (2) by engagement at the teeth of said rotor. Note FIG. 5 which displays pie-shaped central recess (29) of the rotor lock in a perspective fashion, and which indicates the point on the rotary lock that ball member (9) rollably and releasably engages the rotary lock. FIGS. 6, 7 and 8 show alternative biasing positions and the non-locked or unloaded position of the rotary lock (3) and rotor (2) together with the shifter finger (12) placement and the ball (9). The ratchet tool handle of the present invention is of a simpler construction, more secure, and permits selected change in the direction of effective relative rotation between clockwise and counterclockwise by a mere twist of the wrist at no more than 45 degrees, and without any necessity for releasing the grip on the tool, while also permitting secure bias one direction against the other under loaded conditions without any give which was previously a drawback in ratchet tool wrenches of this type. Furthermore, the wrench is more sturdy and has a longer working life because the walls of the housing of said wrench are not used as cam members, and therefore, do not wear out with time as did prior art devices of this type.

Having thus described the invention, it should be noted that the details of the description and drawing on embodiments are intended for illustrative purposes and should not be seen to unduly limit the present invention.

What is claimed is:

1. An improved ratchet tool, for changing operational direction upon manual rotation of a handhold said tool having a one piece housing with an integrally connected head and tubular member, a rotor within the head of the housing to drive the tool, a shaft telescoped within the tubular member of the housing, and an elongated hand-hold projecting laterally from the tubular member of the housing, the improvement comprising:

A rotary lock having two cam surfaces at its periphery displaced one from the other for respective engagement and rotation of the rotor, and having a central recess opposite its cam surfaces, the recess extending sufficiently into the rotary lock to receive a rigid shifter finger but said recess having its walls not more than about 90 degrees apart from one another; said shifter finger being affixed to the end of the shaft and projecting therefrom in a position offset radially from the shaft axis, and operably protruding into the rotary lock recess so that upon a 45 degree turn of the shaft from its neutral or non-locked position the rotary lock's respective cam surfaces may engage the rotor to restrict its rotation in either direction about the axis of rotation of the rotor.

2. The invention of claim 1, wherein is included two parallel roller pins retainably aligning the shaft by laterally resting in a groove bored around the circumference of the shaft.

3. The invention of claim 1, wherein is included a releasable locking member positioned on the tubular member, the releasable locking member comprising a ball member biased into a detent in the handhold by a wavy spring to allow locking of the wrench housing to the handhold when in the non-load position.

* * * * *